US005310288A

United States Patent [19]

Huang

[11] Patent Number: 5,310,288

[45] Date of Patent: May 10, 1994

[54] WORK METHOD FOR STABILIZING AND GREENING A SLOPESIDE OF MUDSTONE OR LACCOLITH

[76] Inventor: Tsun T. Huang, No. 3, Lane 78, Sec. 1, An Ho Road, Taipei, Taiwan

[21] Appl. No.: 9,707

[22] Filed: Jan. 27, 1993

[51] Int. Cl.[5] ..... E02D 3/00; E02D 17/20

[52] U.S. Cl. ..... 405/258; 405/15; 405/36

[58] Field of Search ..... 405/15, 16, 17, 19, 405/258, 36; 47/9, 48.5

[56] References Cited

U.S. PATENT DOCUMENTS

| | | | |
|---|---|---|---|
| 591,256 | 10/1897 | Hunley et al. | 405/15 |
| 2,842,897 | 7/1958 | Finn | 405/258 X |
| 4,572,705 | 2/1986 | Vignon et al. | 405/16 |
| 4,904,121 | 2/1990 | Hallberg | 405/258 |
| 4,984,384 | 1/1991 | Kaufmann | 405/258 X |
| 5,082,398 | 1/1992 | Subic | 405/258 |

*Primary Examiner*—David H. Corbin
*Attorney, Agent, or Firm*—Lowe, Price, LeBlanc & Becker

[57] ABSTRACT

A slopeside of mudstone or laccolith is graded into an artificial slopeside and several oblique and parallel drainage channels are arranged on its surface. Several root planting segments are selected and connected with several root planting tubes provided for communication. The tubes are charged with organic fertilizers and are suitable for burial in the artificial slopeside. Bush packs with lateral roots are planted in each of the root planting segments and the lateral roots are inserted into the root planting tubes so that the roots of different packs grow quickly and entangle intimately with each other to form a stable base for greening the artificial slopeside. Vegetative quick greening bags containing organic material based on the different growing time of herbaceous plants are affixed to the slopeside to distribute the organic materials so as to provide an optimum place for the herbaceous plants to bud and fully grow. Portion of the quick greening bags are affixed onto the root planting tubes to form a protective layer for the tubes. The whole artificial slopeside is sprayed with liquid fertilizers to improve the artificial slopeside quality and facilitate quick growth of herbaceous and woody plants.

30 Claims, 3 Drawing Sheets

WORK METHOD FOR STABILIZING AND GREENING A SLOPESIDE OF MUDSTONE OR LACCOLITH

BACKGROUND OF THE INVENTION

1. Field of the Invention

The present invention relates to a work method for stabilizing and greening a slopeside of mudstone or laccolith, especially to a novel work method for producing herbaceous and woody plants on the mudstone or laccolith in order to enhance the application and protection of the mudstone or laccolith.

2. Description of the Prior Art

Generally, all over the world a work method for stabilizing, greening and protecting a sideslope directed to such ordinary sideslopes as sand or stone is well investigated and developed, however, there is not yet efficient stabilization and soil conservation work of mudstone or laccolith, which are notoriously known as ill terrains.

With respect to the characteristics of mudstone or laccolith, generally speaking, it may be classified as follows:

1. A huge and thick rock layer contains no sandstone, except of minority of mudstone, and is young in the geologic time (belongs to the tertiary of the Cenozoic Era). The component granules are minute (smaller than 0.06 mm), low in the content of bound particles, but high in the content of powdery particles, loose in cementary binding, but hard while dry (24 to 37 mm). Due to the high mud content it is low in lithification. Therefore, the exposed weathering face contacted with the atmosphere is extremely apt to generate mud crack during the dehydration and drying, and the width or depth of the crack ranges from 1–2 mm to several cms densely distributed all over the surface of the earth. Just next to it there is a base composed of water impermeable fresh mudstone, and the interface therebetween will form a weathered and peeled-off layer on long term of drought, but when raining the whole piece will slip off and form a damaged face. Thus, the geologic mudstone has no water reserving layer and no subterranean water for use, therefore, water required by the planted plants all relies on extremely few water stored in the rock crack following raining and artificial watering. Because of the difficulty of obtaining water by plants, the survival rate of plants introduced tends to depress fast during drought seasons, especially woody plants.

2. The mudstone or laccolith per se lacks of sufficient cementing force, and has a large disintegration rate, a weak corrosion resistance and a low effective porosity (about 9–14%), so it has a considerably poor water permeability ($1.785\times10-8$ cm/sec). In view of this, while raining, the rain can not drain downwardly and tends to produce radial flow on the surface of the earth. Furthermore, the mudstone will be swollen and disintegrated by water, and the existence of superficial crack even accelerates and deepens the depth and rate of water entering into the mudstone resulting in an enlarged scale of collapse and loss. The thickness of superficial soil flushed and eroded annually is about above 10 cm in average. So the mudstone contains few organics and effective nutrients, besides, it contains a large amount of alkaline cations and has a pH between 8 and 9 such that it quite unsuits for the growth of plants.

3. Upon contact with water, the superficial layer will absorb water and swell immediately. Due to a too big difference exists between the internal and external swellings, a shear damage results. The vertical drainage rate of the mudstone is lower than the horizontal one (the ratio therebetween is about 2–5:1). While the superficial layer has a quick dewatering tendency, on the contrary, the internal layer has a slower drainage rate and results in a phenomenum of loose inside and tense outside to peel like an onion and form a huge amount of cracks.

4. In many geographical areas, the dry and wet seasons are quite distinctive therebetween. In the case of Taiwan territory, the rainy season is May to September and the drought on November to April; annual rainfall of 1800 to 2500 mm and maximum single daily rainfall of 350 mm; in April it becomes a high temperature of 25° C. and continues till November. So Taiwan has a weather type of temperature high, drought season long and heavy shower. We can see from the aforementioned characteristics that factors for forming a mudstone, an ill terrain disaster are deadly related to its geographical and climate features and conditions. There are so many relevant factors and complex measurements. Therefore, the methods applied and material employed must be of diversification as well as so many methods are used in combination and the problem can not be overcome only by the usual conventional engineering methods.

Conventional engineering methods while applying to such ill lands like mudstone or laccolith will exhibit the following drawbacks:

1. Radial flow phenomum is easy occured on the mudstone or laccolith while raining and flushes off such material as organic fertilizers, seeds and the like added to the solpeside during the planting engineering. Nutrients required by the plants are unable to be reserved and conserved. Plants are always under conditions of water and nutrients insufficient and infertile resulting in weak plants such that they have lower drought tolerance and an accelerated aging and death. The survival rate of plants planted decreases significantly year after year, especially the woody plants.

2. For ameliorate the abovesaid disadvantages, some engineering works, such as cavity planting, steel pile driving and steel network bed, etc. are tried and attempted to efficiently reserve the nutrition material, but found that the mudstone or laccolith has not only high hardness but also toughness to make manual cavity diging, steel pile driving or even powered drilling hard to be accomplished. Besides, the mudstone has a taboo of no disturbance due to places having been dug or driven become the cause of collapse and slip away while raining.

3. It is long preferrably planting herbaceous plants on the slopeside of mudstone or laccolith because of the advantages, such as fast and quick covering. However, according to the research conducted by Dr. Yamatera, Japan, the pull strength of the root system of herbaceous plants becomes weakened year after year, on the contrary, that of woody plants strenthen year after year because of the root system being penetrated deeply and widely. In this manner, for a long term and effective planting measurement, a concept of complex layered cover plants is introduced, which essentially resides in the choice of plant species. Local perennial dominant landcoverings, grasses and flowers, bushes and tall trees, etc are introduced which may dramatically shorten the time period of natural evolution and substitution, make plants covering on the slopeside of mudstone become a rich and lively scene, and also by utilizing network function of exuberant and dense side root system of grasses and the pile and pole function of a deep root system of a woody plant, both exert grabbing and wraping functions onto the soil to enhance the stabilization and immobilization effects onto the slopeside of mudstone. So, a complex layered covering engineering work is essential for mudstone.

Owing to the upper limit of hardness which may be penetrated by root systems is 25 mm, it is noted in many investigations involving the growth of root system in the mudstone terrain that root systems of both woody and herbaceous plants grow along the crack of mudstone and twist and entangle in the interface between the weathering strata and the original slopeside (of a hardness about 37 mm) but can not go on grow downwardly. Then, after a long time, roots of woody plants grow and enlarge to broaden the gap of the original interface and add onto cracks of weathered strata and the width and depth thereof. Therefore, on raining the work becomes a damaging face and a design good originally has a potential risk of slipage in whole on raining.

4. Conventional planting works and materials are limited by the capabilities and mechanisms, in Taiwan, the typhoon period of July to September and the drought period of October to March of the next year should be evaded. Working period is confined to April to June and becomes a difficult problem to the particular timing of the soil conservation of mudstone.

5. If seeds of both herbaceous and woody plants are planted at the same time on the slopeside, it is easy to handle and saves the cost of complex layered covering works. However, owing to most woody plants are slow in budding and weak than herbaceous plants in early age, the dominant herbaceous plants seriously disturb, even totally block the living space for woody plants. Therefore, for so many years, there is no good results from complex layered covering being conducted by means of seeds.

In view of hands of conventional works being tied up by drawbacks of ill lands, mudstone or laccolith, which are the problems desperately await to be solved in many countries, the present inventors devoted to intensive research and investigation and based on the experience of several decades and field tests as well as amelioration, the present invention is completed.

SUMMARY OF THE INVENTION

Accordingly, an object of the present invention is to have a mudstone or laccolith surface adapted to be an environment suitable for the co-existence of woody and herbaceous plants planted.

A next object of the invention is to slow down diverse flows on the surface of the mudstone or laccolith to minimize the surface phase flushed away.

Another object of the invention is to provide a process for cover planting to be applied to the mudstone or laccolith and the like with better stabilizing effect of planting.

A more complete understanding of these and other features and advantages of the present invention will become apparent from a careful consideration of the following detailed description of certain embodiments illustrated in the accompanying drawings.

DETAILED DESCRIPTION OF THE PREFERRED EMBODIMENTS

Figure 1A:
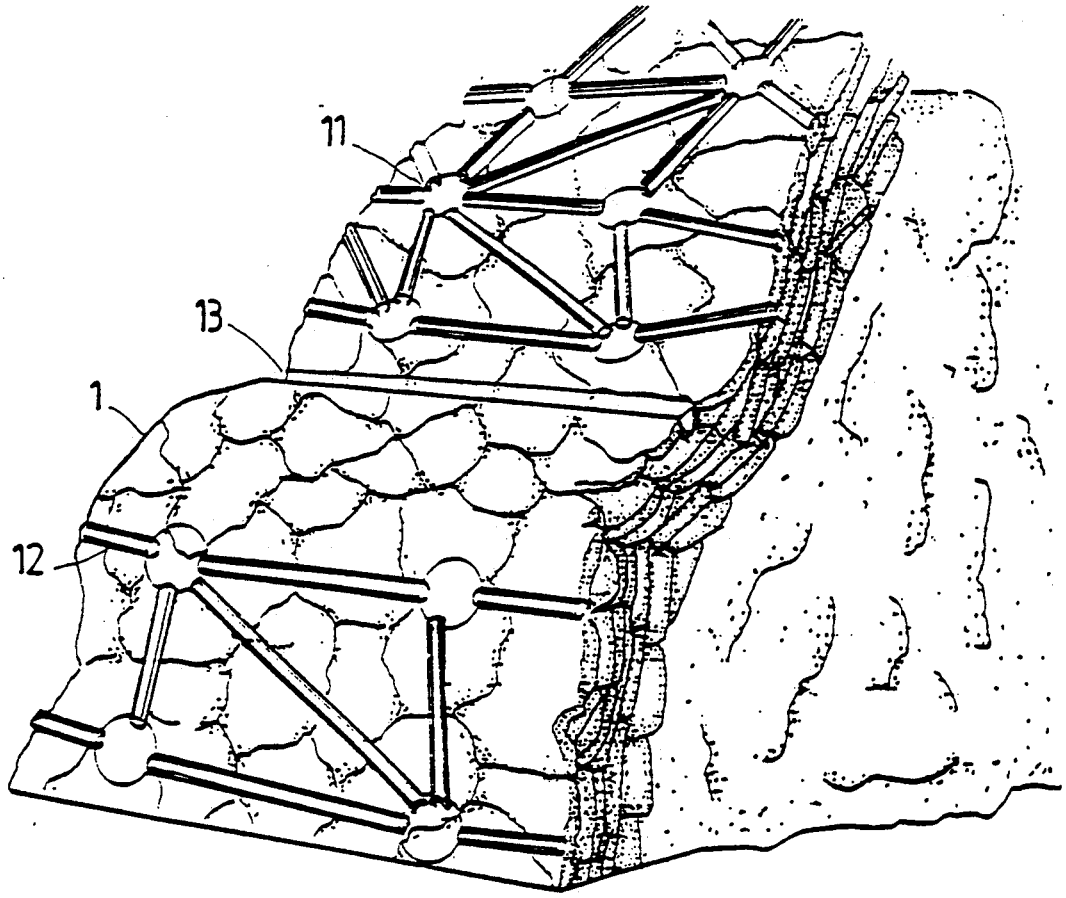
FIG. 1A is an initial distribution view of the present invention applied to a mudstone surface.
Figure 1B:
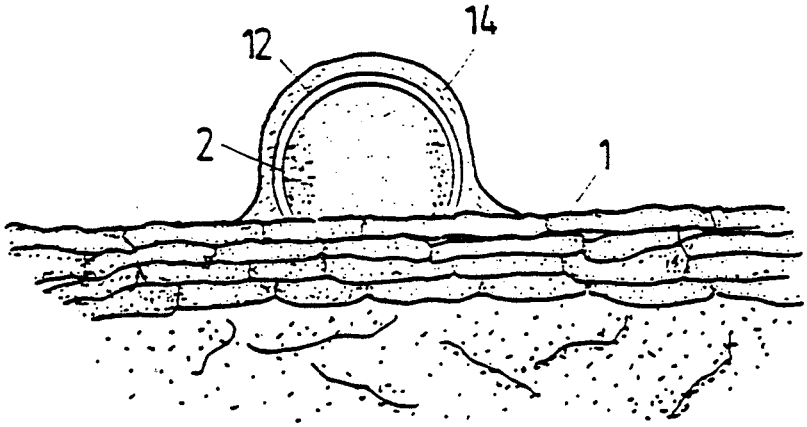
FIG. 1B is a sectional view of a root planting tube applied to a mudstone surface.

As shown in FIG. 1, while practicing the mudstone and laccolith slope side stabilization work of the present invention, the mudstone or laccolith side slope 1 is first graded into an artificial slope, then on the surface of the artificial slope, there are arranged with several oblique and parallel drainage channel 13 and therebetween there are distributed with several root planting area 11; in turn, therebetween there are buried with several root planting tubes 12 which is made of paper material and the like material which may be rotten within a certain period of time and the inside wall of the root planting tubes 12 which emerged out of the mudstone or laccolith surface 1 may be preloaded with organic fertilizers 2 to provide an incubation chamber suitable for the growing of the roots of trees 30. Organic fertilizers 2 comprises organic nutrient, microorganism, slow-release fertilizers, water absorbing granules and the like. Further, the outer periphery of the wall of the tube 12 emerged out of the mudstone surface 1 is coated with a protection layer 14 to prevent the root planting tubes 12 from rotten too quickly and also prevent the herbaceous root plants from invading.

Figure 2:
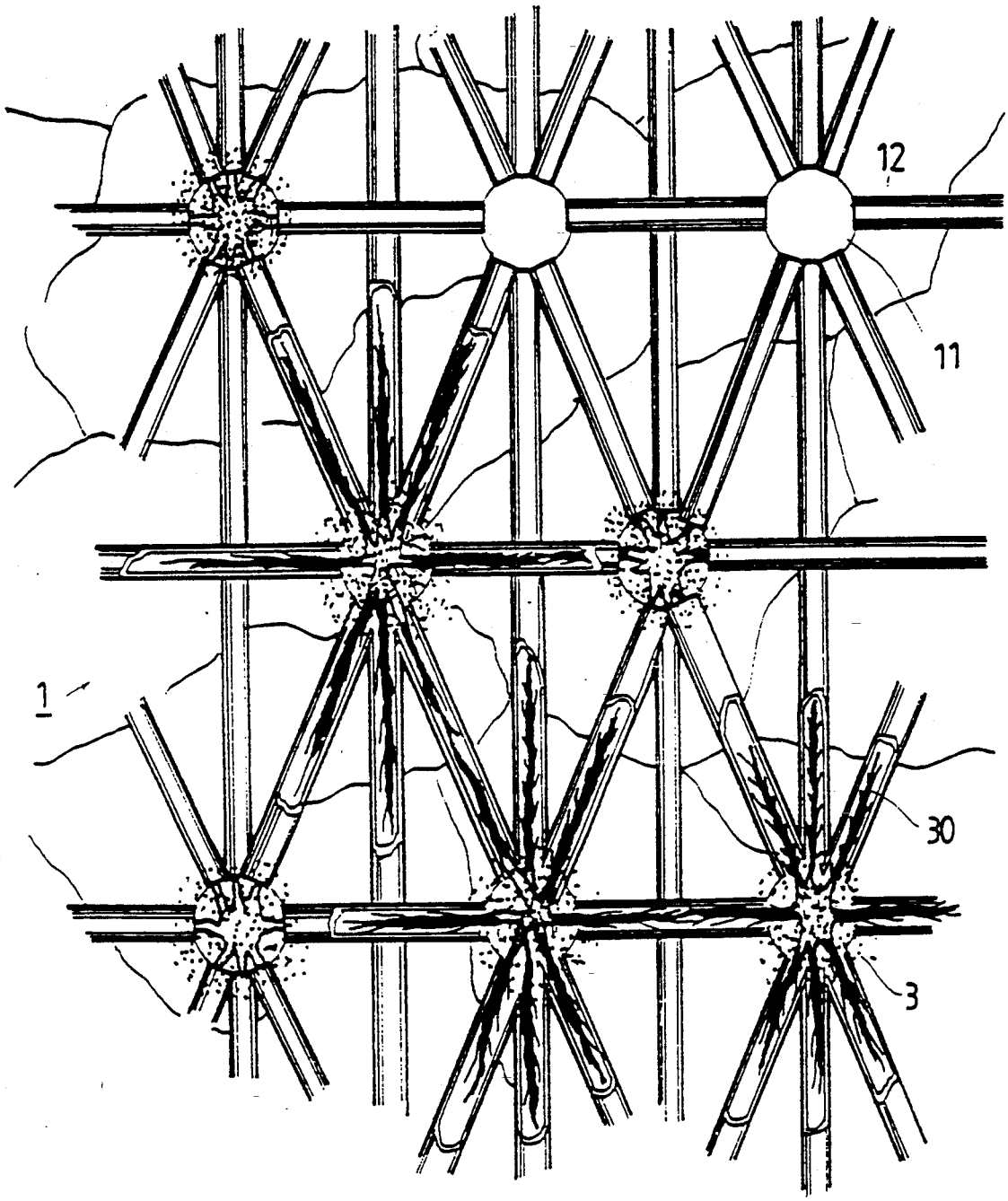
FIG. 2 is a schematic view showing the derivatization of the trees planted in a mudstone surface by applying the invention.

With reference to FIG. 2, the root planting tubes 12 buried between the root planting areas 11 are arranged in a radial form for providing the communication among the root planting areas 11 not far apart. After the root planting tubes 12 are buried and located, planting in the root planting areas 11 the air root plant bushes 3 which is grown beforehand and has lateral oriented roots 30 and introducing the individual root 30 into the tube 12. Owing to the main roots of bushes 3 are cut off before planting and additionally, organic fertilizers 2 in favor of the roots 30 growing rapidly are supplied in the tubes 12, roots 30 of each of the bushes 3 may grow rapidly and entangled with each other. Because the air root plants are not in the same situation of the development of the root systems as other plants originally grown which have to develop downwardly, the root system of the former may grow along the surface of the stone or rock that a tightly hanged on and stable base is formed. Therefore, not only the surface of the mudstone will not be damaged but also a better stable and protective base directed to the poor features of the mudstone is provided.

Figure 3:
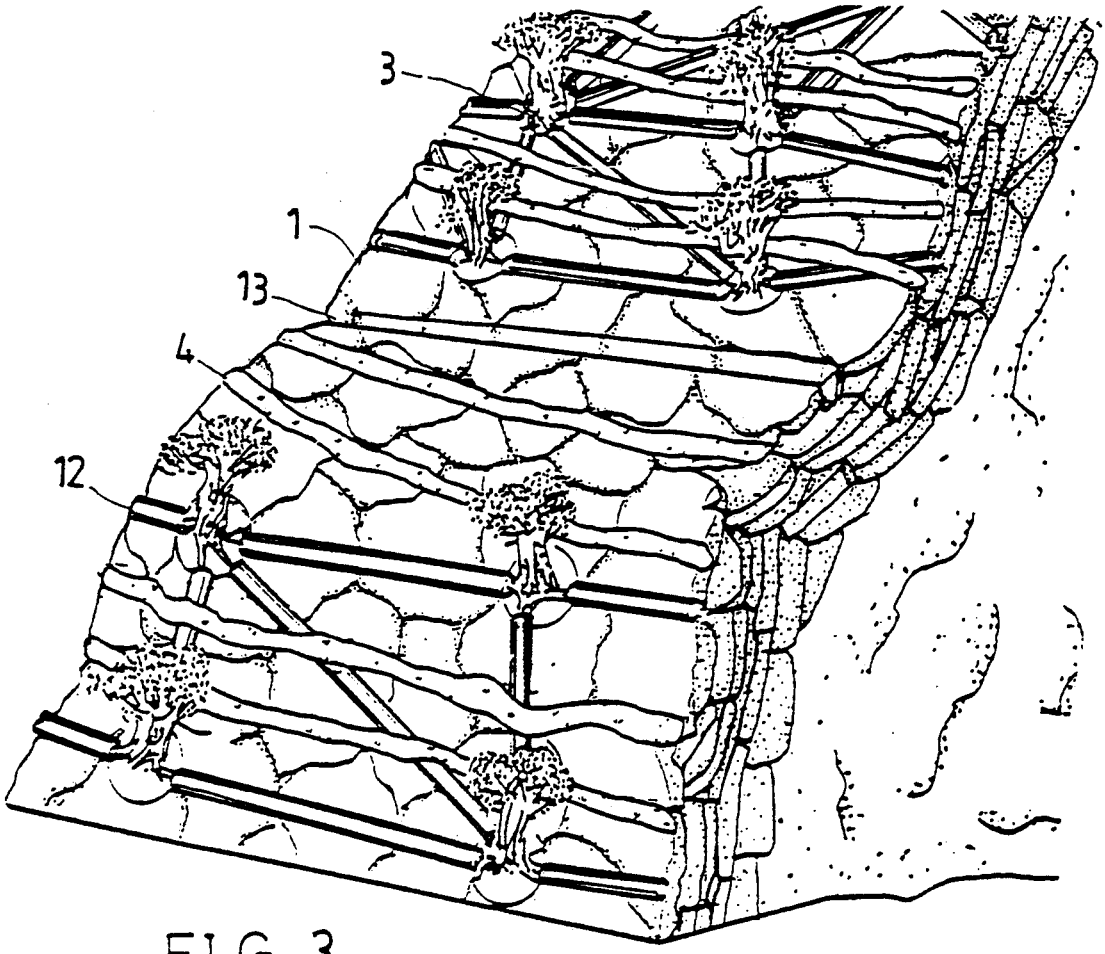
FIG. 3 is a schematic view showing the distribution of the quick greening bag according to the invention.
Figure 4:
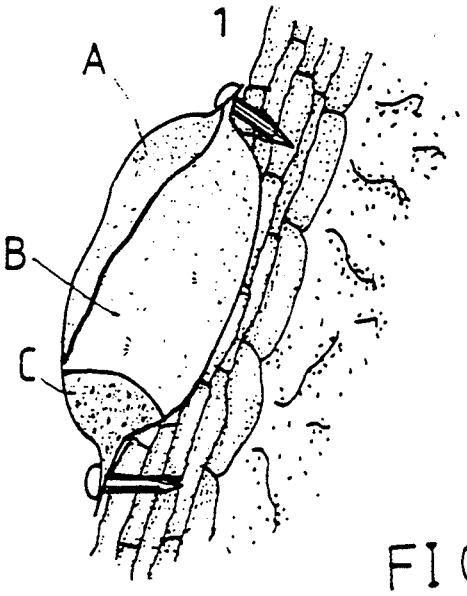
FIG. 4 is a sectional view of the quick greening bag of the invention.

Referring to FIG. 3, following enplanting and locating the bushes 3 and the root planting tubes 12, other exposed portion of the surface of the mudstone and laccolith is immovably provided with quick greening bags 4 in favor of the growing of the herbaceous root plants. Quick greening bags 4 are designed to sufficiently accommodate to growing in the mudstone or laccolith area of various terrains, which are fixedly nailed on the mudstone 1 in equal distance and has an arrangement of ranking between the drainage channels 13 at a slanting angle of 2° such that the downward rain flow is intercepted individually and guided into the drainage channel 13 resulting in shortening the time of water accumulating in the mudstone face and prevention of the diverse flow on the ground surface.

There are several segment designed in the quick greening bag 4 based on the different condition requirement for budding and growing of different plants planted. As shown in the figure, there are provided in the quick greening bag 4 budding segment A, growing segment B and water retaining segment C, etc., wherein, the essential meduium ingredients of the seed budding segment A are peat soil, adequate water absorbant, fertilizers and seeds to provide the optimum environment for the seed budding; the seperation material between the budding segment A and the growing segment B is a porous degradable natural fiber wool, whichby at day 3 or 4 after the seed budding, the root system thereof may extend from the budding segment A to the growing segment B; ingredients of the growing segment B include high organic content mudstone soil, high IB or CDU content slow release fertilizer or higher ratio of water retaining agent, etc. The growing segment B, except for providing nutrients and water for the growth of the plant, the higher ratio of water retaining agent may absorb water and swell as the moisture increases while raining or manual watering, then, the void of the medium in the structure decreases rapidly. The water permeability of the water retaining agent reduced quickly while saturation, so the nutrients will not be washed away and the water and nutrient storage functions are effective. Besides, it has the advantage of good flexibility to comply the terrain and tightly attach to the earth. Furthermore, all the media in the quick greening bag 4 is just thoroughly stirred prior charging into an extremely soft, porous fiber woven bag, therefore, the bag may comply with the terrain and tightly attach to the earth as will, especially after the water absorbing swelling of the water retaining agents.

The essential ingredients of the water retaining segment C comprise of water retaining agents (e.g., polyacrylic series, natural branched starch series and the like) and slow release fertilizers (e.g., IB, CDU). The water retaining agent may reserve 500 times by weight of its own weight. While the volume thereof is swelling by water absortion and saturation, the fiber wool of the bag thereof produces reverse action force due to the swelling force and closes voids in said segment to prevent the water from infiltration such that the invention exhibits the minimum loss of contents of the structure and fertilizers. In view of these, after application of the quick greening bag onto the side face of rocks, even before the growing of the plants planted, on raining, it may vary the surface roughness of the slope and occlude and diverse the flow of the rain.

Further, as shown in said figure, the water reserving segment C is at a lower location of the slope so that in order to preventing the water reserved in the bag after watering or raining from leaking outside of the bag by the gravity, or loss by evaporation, an arc-like water impermeable plastic lining is added to the interior of the fiber wool in the water reserving segment C, therby the moisture evaporation and leaking loss in vain become minimized. When it is drought or water for the plants is deficient, the water reservant will regulate the moisture content of the media in the bag automatically and release adequate water to supply the plants and provide the plants an optimum environment for growth.

After the arrangement and fixment of the bushes 3, root planting tubes 12 and quick greening bag 4, during the period of waiting the growth of the herbaceous or woody plants, a spray work may be added. On the exposed surface of the mudstone, organic soil and liquid fertilizer may be regularly sprayed. The liquid fertilizer contains primarily microorganisms, infiltrating agents, special binding agents, humus acids, trace elements, adequate P, K and water reservant. It can not only have the surface of the mudstone to absorb oxygen to improve the quality of the rock, but also provide the herbaceous and woody plants with an appropriate fertilizer to promote the growth of the herbaceous and woody plants and further provide the plants grown with an optimum land.

In summary, the method for stabilizing and greening the slopeside of the mudstone or laccolith according to the invention comprising land grading the mudstone or laccolith and planting plants with intimately entangled roots, as well as a vegetative quick greening bag completely indicated for the mudstone or laccolith, which may not only well improve the oxygen absorbability of the rock surface layer, but also achieve both functions of drain system and reserving water and oxygen, and prevent the tree roots from damage the rock structure. It is believed that by means of the work method of the invention the problem of road engineering suffering from the mudstone face for a long time may be solved and the road engineering may march into a more prospective and more development potential generation.

Although the present invention has been described with a certain degree of particularity, the present disclosure has been made by way of example and changes in details of construction may be made without departing from the spirite thereof.

I claim:

1. A work method for stabilizing and greening a slopeside of mudstone or laccolith which comprises the following steps:

grading the slopeside of mudstone or laccolith into an artificial slopeside;

arranging several oblique and parallel drainage channels on the surface of said artificial slopeside;

selecting several root planting segments between the drainage channels;

selectively connecting said root planting segments with several root planting tubes provided for communication, the tubes being charged with organic fertilizers and having a lower part suitable for burial in the artificial slopeside;

planting at least one bush pack having lateral roots in each of the root planting segments;

inserting the lateral roots into the root planting tubes in order to have the roots of different packs grow quickly in the tubes and entangle intimately with each other to form a stable base for greening the artificial slopeside;

affixing to the artificial slopeside several vegetative quick greening bags containing organic material based on the different growing time of herbaceous plants, to distribute the organic materials to provide an optimum place for the herbaceous plants to bud and fully grow, a portion of the quick greening bags being affixed onto the root planting tubes to form a protective layer for the tubes;

spraying the whole artificial slopeside with liquid fertilizers for the purpose of improving the artificial slopeside quality and facilitating the quick growth of herbaceous and woody plants.

2. A work method for stabilizing and greening a slopeside of mudstone or laccolith as claimed in claim 1, wherein the liquid fertilizer comprises microorganisms, infiltrating agents, special binding agents, humus acids, trace elements, P, K and water reservant.

3. A work method for stabilizing and greening a slopeside of mudstone or laccolith as claimed in claim 1, wherein each vegetative quick greening bag is placed at an angle of about 2° from one of the drainage channels.

4. A work method for stabilizing and greening a slopeside of mudstone or laccolith as claimed in claim 1, wherein the bush pack is an air root plant and should the plant have a main root, first cutting the main root off during planting and cultivation.

5. A work method for stabilizing and greening a slopeside of mudstone or laccolith as claimed in claim 1, wherein the root planting tube is made of material which tends to rot within a specified period of time.

6. A work method for stabilizing and greening a slopeside of mudstone or laccolith as claimed in claim 5, including providing the root planting tube with an external protective layer to prevent water or roots of grasses from invading, and wherein the organic fertilizer charging the tube comprises organic oxygenaceous material, microorganisms, slow-release fertilizers and water absorbing granules.

7. A work method for stabilizing and greening a slopeside of mudstone or laccolith as claimed in claim 6, including providing the root planting tube with a lining to more firmly stabilize the root planting tube.

8. A work method for stabilizing and greening a slopeside of mudstone or laccolith as claimed in claim 1, wherein the root planting tubes are arranged radially.

9. A work method for stabilizing and greening a slopeside of mudstone or laccolith as claimed in claim 1, wherein the vegetative quick greening bags comprise a budding area, a growing area and a water reserving area, and, wherein the method further includes providing in each of the areas proper media for seed growth and stirring the media in each of the areas thoroughly prior to charging into the bags such that the bags containing the media are soft and able to attach and stick to the artificial slopeside.

10. A work method for stabilizing and greening a slopeside of mudstone or laccolith as claimed in claim 8, wherein the vegetative quick greening bags are made of an artificial fiber and cotton material.

11. A work method for stabilizing and greening a slopeside of mudstone or laccolith as claimed in claim 9, wherein in the quick greening bags, the media contained in the budding area comprise peat earth, water reservant, fertilizer and seeds, the media contained in the growing area comprise high organic content of IB or CDU slow release fertilizers and a high ratio of water reservant, and the media contained in the water reserving area comprise water reservants and slow-release fertilizers.

12. A work method for stabilizing and greening a slopeside of mudstone or laccolith as claimed in claim 9, including separately the budding area, the growing area and the water reservant area of the quick greening bags by a porous natural fiber and cotton material.

13. A work method for stabilizing and greening a slopeside of mudstone or laccolith as claimed in claim 9, including the step of preventing oxygen and water loss from the quick greening bags by establishing a void area in each bag equal to two thirds of the maximum volume of the water reservant after water absorbing and swelling so that the bags remain closed following the water reservant absorbing water and swelling.

14. A work method for stabilizing and greening a slopeside of mudstone or laccolith as claimed in claim 8, including reducing evaporation and leakage of water by providing downslope surfaces of selective vegetative quick greening bags with a water tight protective layer.

15. A work method for stabilizing and greening a slopeside of mudstone or laccolith as claimed in claim 1, including facilitating ingestion of root system oxygen by arranging the branches, leaves and stem height of the planted bush packs.

16. A system for stabilizing and greening a graded slopeside of mudstone or laccolith comprising:

oblique drainage channels arranged in parallel on the surface of said slopeside;

root planting segments located between the drainage channels;

root planting tubes selectively connecting said root planting segments provided for communication, the tubes being charged with organic fertilizers and having a lower part suitable for burial in the slopeside;

at least one bush pack having lateral roots planted in each of the root planting segments with the lateral roots being inserted into the root planting tubes in order to have the roots of different packs grow quickly in the tubes and entangle intimately with each other to form a stable base for greening the slopeside;

vegetative quick greening bags containing organic material based on the different growing time of herbaceous plants, affixed to the slopeside to distribute the organic materials to provide an optimum place for the herbaceous plants to bud and fully grow, a portion of the quick greening bags being affixed onto the root planting tubes to form a protective layer for the tubes; and a liquid fertilizer sprayed onto the slopeside for the purpose of improving the slopeside quality and facilitating the quick growth of herbaceous and woody plants.

17. A system for stabilizing and greening a slopeside of mudstone or laccolith as claimed in claim 16, wherein the liquid fertilizer comprises microorganisms, infiltrating agents, special binding agents, humus acids, trace elements, P, K and water reservant.

18. A system for stabilizing and greening a slopeside of mudstone or laccolith as claimed in claim 16, wherein each vegetative quick greening bag is placed at an angle of about 2° from one of the drainage channels.

19. A system for stabilizing and greening a slopeside of mudstone or laccolith as claimed in claim 16, wherein the bush pack is an air root plant and should the plant have a main root, the main root is first cut off during planting and cultivation.

20. A system for stabilizing and greening a slopeside of mudstone or laccolith as claimed in claim 16, wherein the root planting tube is made of material which tends to rot within a specified period of time.

21. A system for stabilizing and greening a slopeside of mudstone or laccolith as claimed in claim 20, wherein the root planting tube is provided with an external wall protective layer to prevent water or roots of grasses from invading, and wherein the organic fertilizer charging the tube comprises organic oxygenaceous material, microorganisms, slow-release fertilizers and water absorbing granules.

22. A system for stabilizing and greening a slopeside of mudstone or laccolith as claimed in claim 21, wherein the root planting tube is further provided with a lining to more firmly stabilize the root planting tube.

23. A system for stabilizing and greening a slopeside of mudstone or laccolith as claimed in claim 16, wherein the root planting tubes are arranged radially.

24. A system for stabilizing and greening a slopeside of mudstone or laccolith as claimed in claim 16, wherein the vegetative quick greening bags comprise a budding area, a growing area and a water reserving area, and, wherein the system further includes proper media in each of the areas for seed growth with the media in each of the areas being stirred thoroughly prior to charging into the bags such that the bags containing the media are soft and able to attach and stick to the slopeside.

25. A system for stabilizing and greening a slopeside of mudstone or laccolith as claimed in claim 23, wherein the vegetative quick greening bags are made of an artificial fiber and cotton material.

26. A system for stabilizing and greening a slopeside of mudstone or laccolith as claimed in claim 24, wherein in the quick greening bags, the media contained in the budding area comprise peat earth, water reservant, fertilizer and seeds, the media contained in the growing area comprise high organic content of IB or CDU slow release fertilizers and a high ratio of water reservant, and the media contained in the water reserving area comprise water reservants and slow-release fertilizers.

27. A system for stabilizing and greening a slopeside of mudstone or laccolith as claimed in claim 24, wherein the budding area, the growing area and the water reservant area of the quick greening bags are separated by a porous natural fiber and cotton material.

28. A system for stabilizing and greening a slopeside of mudstone or laccolith as claimed in claim 24, wherein the quick greening bags are further comprised of a void area in each bag equal to two thirds of the maximum volume of the water reservant after water absorbing and swelling so that the bags remain closed following the water reservant absorbing water and swelling.

29. A system for stabilizing and greening a slopeside of mudstone or laccolith as claimed in claim 23, wherein downslope surfaces of selective vegetative quick greening bags are additionally provided with a water tight protective layer to reduce the evaporation and leakage of water.

30. A system for stabilizing and greening a slopeside of mudstone or laccolith as claimed in claim 16, wherein the bush packs have branches, leaves and stem height arranged to facilitate the ingestion of oxygen required by the root system.

* * * * *